US006656583B1

(12) United States Patent
Cziollek et al.

(10) Patent No.: US 6,656,583 B1
(45) Date of Patent: Dec. 2, 2003

(54) HIGH-STRENGTH POLYESTER THREADS AND METHOD FOR PRODUCING THE SAME

(75) Inventors: Joachim Cziollek, Mainz (DE); Werner Mrose, Maintal (DE); Dietmar Wandel, Hanau (DE); Helmut Schwind, Hanau (DE); Wolfgang Janas, Geiselbach (DE); Werner Ude, Darmstadt (DE)

(73) Assignee: Lurgi Zimmer AG, Frankfurt am Main (DE)

( * ) Notice: Subject to any disclaimer, the term of this patent is extended or adjusted under 35 U.S.C. 154(b) by 0 days.

(21) Appl. No.: 10/049,010

(22) PCT Filed: Jul. 25, 2000

(86) PCT No.: PCT/EP00/07086

§ 371 (c)(1),
(2), (4) Date: May 21, 2002

(87) PCT Pub. No.: WO01/11123

PCT Pub. Date: Feb. 15, 2001

(30) Foreign Application Priority Data

Aug. 10, 1999 (DE) ..... 199 37 729

(51) Int. Cl.[7] ..... D01F 6/00; D01F 6/92; B01D 5/16

(52) U.S. Cl. ..... 428/372; 428/364; 428/395; 264/176.1; 264/177.13; 264/210.8

(58) Field of Search ..... 428/372, 364, 428/395; 264/176.1, 177.13, 177.17, 210.8

(56) References Cited

U.S. PATENT DOCUMENTS

| | | | | |
|---|---|---|---|---|
| 5,092,381 A | | 3/1992 | Feijen et al. | 152/451 |
| 5,565,522 A | | 10/1996 | Bohringer et al. | 525/176 |
| 5,962,131 A | * | 10/1999 | Schwind et al. | 428/364 |

FOREIGN PATENT DOCUMENTS

| | | |
|---|---|---|
| EP | 0 201 114 A | 11/1986 |
| EP | 0 631 638 B | 2/1996 |
| WO | WO 90 00638 A | 1/1990 |
| WO | WO 99 07927 A | 2/1999 |
| WO | WO 11/122 A1 * | 2/2001 |

* cited by examiner

*Primary Examiner*—N Edwards
(74) *Attorney, Agent, or Firm*—Norris McLaughlin & Marcus

(57) ABSTRACT

High strength polyester fibers comprising from 0.1 to 2.0 by weight of an incompatible, thermoplastic amorphous, polymeric additive.

14 Claims, No Drawings

HIGH-STRENGTH POLYESTER THREADS AND METHOD FOR PRODUCING THE SAME

The invention relates to high-strength polyester filaments having a tear strength of >70 cN/tex, and to a process for the production of these filaments.

High-strength filaments made from polyethylene terephthalate and processes for the production thereof have been known for some time (F. Fourné, Synthetische Fasern [Synthetic Fibres], Hanser Verlag, Munich [1995] 584–586; U.S. Pat. Nos. 3,758,658, 4,374,797 and 4,461,740).

In these high-strength filaments, particular properties, especially high tear strength, low elongation at break and a low number of filament flaws, are required. These requirements are linked in technological terms to the use of high stretching ratios of at least 1:5 in raw yarn production. However, higher stretching ratios have their limit if the filament is already damaged by the stretching and filament breakage occurs. The higher the production speed, the lower this limit. However, the technical and economic value of the spin-stretch process on use of high production speeds can only be regarded as positive if the textile filament qualities are not impaired at the same time, but instead are even improved. Thus, the spinning take-off speed in commercial processes is limited to a maximum of 700 m/min, in general from 500 to 600 m/min. The wind-up speed is, corresponding to the stretching ratio, from greater than 2500 m/min to less than 3800 m/min.

It is furthermore known from WO 99/07927 A1 that the elongation at break of polyester pre-oriented yarn (POY) which has been spun at take-off speeds of at least 2500 m/min, preferably from 3000 to 6000 m/min, can be increased by the addition of amorphous, thermo-plastic copolymers based on styrene, acrylic acid and/or maleic acid or derivatives thereof compared with the elongation at break of polyester filaments spun under identical conditions without addition. However, the process cannot be applied to spun filaments produced at take-off speeds of less than 2500 m/min since these, in contrast to POY, are of low crystallinity (<12%) and have low orientation (birefringence<$25\cdot10^{-3}$) and high elongation at break (>225%). No data are given on the production of high-strength yarns in the integrated spin-stretch process.

EP 0 047 464 B relates to an unstretched polyester yarn where improved productivity is obtained at speeds of between 2500 and 8000 m/min by increasing the elongation at break of the spun filament by addition of 0.2–10% by weight of a polymer of the $—(—CH_2—CR_1R_2—)—_n$ type, such as poly(4-methyl-1-pentene) or polymethyl methacrylate. Fine and uniform dispersion of the additive polymer by mixing is necessary, where the particle diameter must be $\leqq 1$ $\mu$m in order to avoid fibril formation. The crucial factor for the effect is said to be the interaction of three properties—the chemical structure of the additive, which hardly allows any elongation of the additive molecules, the low mobility and the compatibility of polyester and additive.

EP 0 631 638 B describes fibres predominantly comprising PET which comprises 0.1–5% by weight of a polyalkyl methacrylate which has been imidated to the extent of 50–90%. The fibres obtained at speeds of 500–10,000 m/min and subsequently subjected to final stretching are said to have a relatively high initial modulus. In the examples of industrial yarns, the effect on the modulus is not readily evident; in general, the strengths achieved are low, which is a considerable disadvantage of this product.

It is also known to the person skilled in the art that the tear strength can be dramatically affected by changing the relaxation proportion with the same spinning and stretching conditions. In practice, the thermal shrinkage of high-strength filaments of this type is adjusted, depending on the industrial area of application, by means of the relaxation ratio. The thermal shrinkage is reduced with increasing relaxation ratio, but so are the tear strength and LASE 5, whereas the elongation at break increases.

The present invention has the object of providing high-strength polyester filaments having a tear strength of >70 cN/tex and a process for the production thereof in which it is possible to use spinning take-off speeds and wind-up speeds which are significantly above those of the prior art. In particular, it should be possible to achieve tear strengths of >80 cN/tex at a relaxation ratio RR of $\geqq 0.97$, tear strengths of >77 cN/tex at a relaxation ratio of $0.95<RR<0.97$, and tear strengths of >70 cN/tex at a relaxation ratio RR of <0.95.

This object is achieved in accordance with the invention by high-strength polyester filaments and by a process for the production thereof as indicated in the patent claims.

The term polyester here is taken to mean poly($C_{2-4}$-alkylene)terephthalates, which may comprise up to 15 mol % of other dicarboxylic acids and/or dials, such as, for example, isophthalic acid, adipic acid, diethylene glycol, polyethylene glycol, 1,4-cyclohexanedimethanol, or the respective other $C_{2-4}$-alkylene glycols. Preference is given to polyethylene terephthalate having an intrinsic viscosity (I.V.) in the range from 0.8 to 1.4 dl/g, polypropylene terephthalate having an I.V. of from 0.9 to 1.6 dl/g and polybutylene terephthalate having an I.V. of from 0.9 to 1.8 dl/g. Conventional additives, such as dyes, matting agents, stabilizers, antistatics, lubricants and branching agents, may be added to the polyester or polyester/additive mixture in amounts of from 0 to 5.0% by weight without any disadvantage.

In accordance with the invention, a copolymer is added to the polyester in an amount of from 0.1 to 2.0% by weight, where the copolymer must be amorphous and substantially insoluble in the polyester matrix. The two polymers are essentially incompatible with one another and form two phases which can be differentiated microscopically. Furthermore, the copolymer must have a glass transition temperature (determined by DSC at a heating rate of 10° C./min) of from 90 to 170° C. and must be thermoplastic.

The melt viscosity of the copolymer should be selected here so that the ratio of its melt viscosity extrapolated to the measurement time zero, measured at an oscillation rate of 2.4 Hz and a temperature which is equal to the melting point of the polyester plus 34.0° C. (290° C. for polyethylene terephthalate) relative to that of the polyester, measured under the same conditions, is between 1:1 and 7:1, i.e. the melt viscosity of the copolymer is at least equal to or preferably greater than that of the polyester. The optimum effectiveness is only achieved through the choice of a specific viscosity ratio of additive to polyester. At a viscosity ratio optimised in this way, it is possible to minimize the amount of additive added, making the economic efficiency of the process particularly high. Surprisingly, the viscosity ratio determined as ideal in accordance with the invention for the use of polymer mixtures for the production of high-strength yarns is above the range indicated as favourable in the literature for the mixing of two polymers. In contrast to the prior art, polymer mixtures with high-molecular-weight copolymers were highly suitable for spinning.

Due to the high flow activation energy of the additive polymers, the viscosity ratio after exit of the polymer mixture from the spinneret increases dramatically in the filament formation zone. The flow activation energy (E) here is a measure of the rate of change of the zero viscosity as a function of the change in measurement temperature, where the zero viscosity is the viscosity extrapolated to the shear rate 0 (M. Pahl et al., Praktische Rheologie der Kunststoffe und Elastomere [Practical Rheology of Plastics and Elastomers], VDI-Verlag, Düsseldorf (1995), pages 256 ff.). Through the choice of a favourable viscosity ratio, a particularly narrow particle size distribution of the additive in the polyester matrix is achieved, and by combining the viscosity ratio with a flow activation energy which is significantly greater than that of the polyester (PET about 60 kJ/mol), i.e. greater than 80 kJ/mol, a fibril structure of the additive is obtained in the spun filament. The high glass transition temperature compared with the polyester ensures rapid solidification of this fibril structure in the spun filament. The maximum particle sizes of the additive polymer here immediately after exiting from the spinneret are about 1000 nm, while the mean particle size is 400 nm or less. After drawing beneath the spinneret and after stretching, fibrils having a mean diameter of ≦80 nm are formed.

The ratio between the melt viscosity of the copolymer and that of the polyester under the above-mentioned conditions is preferably between 1.5:1 and 5:1. Under these conditions, the mean particle size of the additive polymer immediately after exiting from the spinneret is 120–300 nm, and fibrils having a mean diameter of about 40 nm are formed.

The additive polymers to be added in accordance with the invention to the polyester may have a different chemical composition so long as they have the above-mentioned properties. Three different types of copolymer are preferred, namely 1. A copolymer which comprises the following monomer units:
   A=acrylic acid, methacrylic acid or $CH_2{=}CR{-}COOR^1$, where R is an H atom or a $CH_3$ group, and $R^1$ is a $C_{1-15}$-alkyl radical or a $C_{5-12}$-cycloalkyl radical or a $C_{6-14}$-aryl radical,
   B=styrene or $C_{1-3}$-alkyl-substituted styrenes,
   where the copolymer consists of from 60 to 98% by weight of A and from 2 to 40% by weight of B, preferably of from 83 to 98% by weight of A and from 2 to 17% by weight of B, and particularly preferably of from 90 to 98% by weight of A and from 2 to 10% by weight of B (sum=100% by weight).
2. A copolymer which comprises the following monomer units:
   C=styrene or $C_{1-3}$-alkyl-substituted styrenes,
   D=one or more monomers of the formula I, II or III (I)

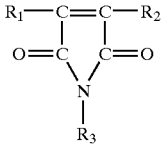

(II)

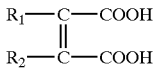

-continued (III)

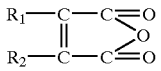

where $R_1$, $R_2$ and $R_3$ are each an H atom or a $C_{1-15}$-alkyl radical or a $C_{5-12}$-cycloalkyl radical or a $C_{6-14}$-aryl radical, where the copolymer consists of from 15 to 95% by weight of C and from 5 to 85% by weight of D, preferably of from 50 to 90% by weight of C and from 10 to 50% by weight of D, and particularly preferably of from 70 to 85% by weight of C and from 15 to 30% by weight of D, where the sum of C and D together gives 100%.

3. A copolymer which comprises the following monomer units:
   E=acrylic acid, methacrylic acid or $CCH_2{=}CR{-}COOR^1$, where R is an H atom or a $CH_3$ group, and $R^1$ is a $C_{1-15}$-alkyl radical or a $C_{5-12}$-cycloalkyl radical or a $C_{6-14}$-aryl radical,
   F=styrene or $C_{1-3}$-alkyl-substituted styrenes,
   G=one or more monomers of the formula I, II or III (I)

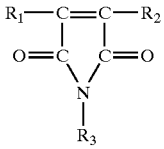

(II)

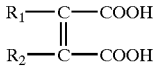

(III)

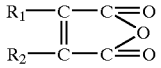

where $R_1$, $R_2$ and $R_3$ are each an H atom or a $C_{1-15}$-alkyl radical or a $C_{5-12}$-cycloalkyl radical or a $C_{6-14}$-aryl radical, H=one or more ethylenically unsaturated monomers which can be copolymerized with E and/or with F and/or G, from the group consisting of α-methylstyrene, vinyl acetate, acrylates and methacrylates which are different from E, vinyl chloride, vinylidene chloride, halogen-substituted styrenes, vinyl esters, isopropenyl ethers and dienes, where the copolymer consists of from 30 to 99% by weight of E, from 0 to 50% by weight of F, from >0 to 50% by weight of G and from 0 to 50% by weight of H, preferably of from 45 to 97% by weight of E, from 0 to 30% by weight of F, from 3 to 40% by weight of G and from 0 to 30% by weight of H, and particularly preferably of from 60 to 94% by weight of E, from 0 to 20% by weight of F, from 6 to 30% by weight of G and from 0 to 20% by weight of H, where the sum of E, F, G and H together gives 100%.

Component H is an optional component. Although the advantages to be achieved in accordance with the invention can be achieved merely by means of copolymers which have components from groups E to G, the advantages to be achieved in accordance with the invention also arise if further monomers from group H are involved in the build-up of the copolymer to be employed in accordance with the invention.

Component H is preferably selected in such a way that it does not have an adverse effect on the properties of the copolymer to be used in accordance with the invention. Component H can therefore be employed, inter alia, in order to modify the properties of the copolymer in the desired manner, for example by increasing or improving the flow properties when the copolymer is heated to the melting point, or for reducing a residual colour in the copolymer or through the use of a polyfunctional monomer in order in this way to introduce a certain degree of crosslinking into the copolymer. In addition, H may also be selected in such a way that copolymerization of components E to G only becomes possible at all or is supported, as in the case of MSA and MMA, which do not copolymerise per se, but copolymerise without difficulty on addition of a third component, such as styrene.

The monomers which are suitable for this purpose include, inter alia, vinyl esters, esters of acrylic acid, for example methyl and ethyl acrylate, esters of methacrylic acid other than methyl methacrylate, for example butyl methacrylate and ethylhexyl methacrylate, vinyl chloride, vinylidene chloride, styrene, α-methylstyrene and the various halogen-substituted styrenes, vinyl and isopropenyl ethers, and dienes, such as, for example, 1,3-butadiene and divinylbenzene. The reduction in colour of the copolymer can, for example, particularly preferably be achieved by use of an electron-rich monomer, such as, for example, a vinyl ether, vinyl acetate, styrene or α-methylstyrene. Of the compounds of component H, particular preference is given to aromatic vinyl monomers, such as, for example, styrene or α-methylstyrene.

The preparation of the copolymers to be used in accordance with the invention is known per se. They can be prepared by mass, solution, suspension or emulsion polymerisation. Helpful information on mass polymerisation is given in Houben-Weyl, Volume E20, Part 2 (1987), pages 1145 ff. Information on solution polymerisation is likewise given therein on pages 1149 ff., while emulsion polymerisation is likewise mentioned and explained therein on pages 1150 ff.

For the purposes of the invention, particular preference is given to bead polymers whose particle size is in a particularly favourable range. The copolymers to be used in accordance with the invention by, for example, mixing into the melt of the fibre polymers are preferably in the form of particles having a mean diameter of from 0.1 to 1.0 mm. However, larger or smaller beads or granules can also be employed, although smaller beads make particular demands on logistics, such as conveying and drying.

The imidated copolymer types 2 and 3 can be prepared either from the monomers using a monomeric imide or by subsequent complete or preferably partial imidation of a copolymer containing the corresponding maleic acid derivative. These additive polymers are obtained, for example, by complete or preferably partial reaction of the corresponding copolymer in the melt phase with ammonia or a primary alkylamine or arylamine, for example aniline (Encyclopedia of Polymer Science and Engineering, Vol. 16 [1989], Wiley-Verlag, page 78). All the copolymers according to the invention and, if indicated, their non-imidated starting copolymers are commercially available or can be prepared by a process which is familiar to the person skilled in the art.

The amount of copolymer to be added to the polyester is from 0.1 to 2.0% by weight, with added amounts of less than 1.5% usually being sufficient. The concentration of the polymeric additive is preferably selected in the range from 0.1 to 2.0% by weight, depending on the desired spinning take-off speed (>700–1500 m/min), in such a way that the birefringence of the spun filament is $<3.5\cdot10^{-3}$. Birefringence values of this type in the spun filament allow stretching ratios of 1:5 and ensure the desired high filament strengths irrespective of the spinning take-off speed of up to 1500 m/min at wind-up speeds which are also significantly above 3800 m/min.

In this case, the concentration of the additive is determined experimentally in preliminary experiments under operating conditions as follows:

The stretching ratio necessary to achieve high strengths is known to the person skilled in the art for a certain polymer without an additive according to the invention under the specific spinning and stretching conditions at a spinning take-off speed $v_0$. He is also familiar with the birefringence of the spun filament in this process or is able to determine the latter. If he would now like to carry out the process in accordance with the invention at higher speeds, he merely has to determine the concentration of additive with which the spun filament has the same birefringence as the spun filament at $v_0$ without additive. To this end, the birefringence at the higher spinning speed is determined for about four different additive concentrations in the range from 0.1% to 1.5%, and the necessary concentration is determined from the graphic representation of this correlation by interpolation.

The mixing of the additive polymer (copolymer) with the matrix polymer is carried out by addition in the form of a solid to the matrix polymer chips in the extruder feed with chip mixer or gravimetric metering or alternatively by melting the additive polymer, metering by means of a gear pump and feeding into the melt stream of the matrix polymer. So-called masterbatch methods are also possible, where the additive is in the form of a concentrate in polyester chips, which are later added in the solid or molten state to the matrix polyester. Addition to a part-stream of the matrix polymer, which is then admixed with the main stream of the matrix polymer, is also practicable.

A homogeneous distribution is subsequently produced by mixing by means of static mixers. A defined particle distribution is advantageously established through a specific choice of the mixer and the duration of the mixing process before the melt mixture is fed on through product distribution lines to the individual spinning positions and spinnerets. Mixers having a shear rate of from 16 to 128 $sec^{-1}$ have proven successful. The product of the shear rate ($sec^{-1}$) and the residence time (in sec) to the power 0.8 here should be at least 250, preferably from 350 to 1250. Values above 2500 are generally avoided in order to limit the pressure drop in the pipelines.

The shear rate here is defined by the empty pipe shear rate ($sec^{-1}$) times the mixer factor, where the mixer factor is a characteristic parameter of the mixer type. For Sulzer SMX models, for example, this factor is about 7–8. The shear rate γ in the empty pipe is calculated from $$\gamma = \frac{4\cdot10^3\cdot F}{\pi\cdot\delta\cdot R^3\cdot 60}[\mathrm{sec}^{-1}]$$

and the residence time t (sec) is calculated from $$t = \frac{V_2\cdot\varepsilon\cdot\delta\cdot 60}{F}$$

where

F=polymer transport rate (g/min)

$V_2$=internal volume of the empty pipe ($cm^3$)

R=empty pipe radius (mm)

$\epsilon$=empty volume proportion (from 0.84 to 0.88 in the case of Sulzer SMX models)

$\delta$=nominal density of the polymer mixture in the melt (about 1.2 g/cm$^3$).

Both the mixing of the two polymers and the subsequent spinning of the polymer mixture are carried out at temperatures, depending on the matrix polymer, in the range from 220 to 320° C., preferably at (melting point of the matrix polymer+34) ±25° C. For PET, temperatures of from 265 to 315° C. are preferably set.

The production of the high-strength filaments from the polymer mixtures according to the invention by spinning at take-off speeds of >700 m/min, preferably from 750 to 1000 m/min, stretching at a stretching ratio of at least 1:5, heat setting and winding up at a corresponding speed of >3800 m/min is carried out using spinning apparatuses known per se. The filter pack here is fitted with filter devices and/or loose filter media in accordance with the known prior art.

After shear and filtration treatment in the spinneret pack, the molten polymer mixture is pressed through the holes of the spinneret plate. In the subsequent cooling zone. the melt filaments are cooled to below their solidification point by means of cooling air, so preventing sticking or bunching at the subsequent filament guide element. The cooling air can be supplied from an air-conditioning system by transverse or radial blowing. After cooling, the spun filaments are treated with spin finish, taken off at a defined speed via godet roll systems, subsequently stretched, heat-set and finally wound up.

It is typical of high-strength polyester filaments that they are produced in large direct melt spinning machines in which the melt is distributed over the individual spinning lines and over the individual spinning systems within the lines via long heated product lines. A spinning line here is a lining up of at least one row of spinning systems, and a spinning system represents the smallest spinning unit with a spinning head which contains at least one spinneret pack including spinneret plates.

The melt in such systems is subjected to a high thermal load at residence times of up to 35 minutes. As a consequence of the high thermal stability of the additive, the effectiveness of the polymer additive according to the invention does not result in any significant restriction of its action, and consequently a small added amount of the additive of ≦2.0% and in many cases ≦1.5% is sufficient in spite of a high thermal load.

An improvement in the stretchability is achieved in accordance with the invention, characterized by the same stretching ratio at a higher spinning take-off speed. In particular, a suitable choice of the additive concentration C enables the spinning take-off speed at the spinneret to be set at least 200 m/min higher than in the case of spinning of polyester without addition of additive.

The properties of the additive polymer and the mixing technique have the effect that the additive polymer forms spheroidal or elongated particles in the matrix polymer immediately after exit of the polymer mixture from the spinneret. The best conditions arose when the mean particle size (arithmetic mean) $d_{50}$ was ≦400 nm, and the proportion of particles >1000 nm in a sample cross section was less than 1%.

The effect of the spinning draft or stretching on these particles has been determined analytically. Recent investigations of the filaments by the TEM (transmission electron microscopy) method have shown that a fibril-like structure exists therein. The mean diameter of the fibrils after stretching was estimated at about 40 nm, and the length/diameter ratio of the fibrils at >50. If these fibrils are not formed or if the additive particles after exiting from the spinneret are too large in diameter or if the size distribution is not uniform enough, which is the case at an inadequate viscosity ratio, the effect is lost.

Furthermore, a glass transition temperature of from 90 to 170° C. and preferably a flow activation energy of the copolymers of at least 80 kJ/mol, i.e. a higher flow activation energy than that of the polyester matrix, is necessary for the effectiveness of the additives in accordance with this invention. Under this prerequisite, it is possible for the additive fibrils to solidify before the polyester matrix and to absorb a considerable proportion of the spinning stress present.

The high-strength filaments according to the invention have at least the same quality values as conventional filaments without a polymeric additive.

The property values indicated in the following examples and in the above text were determined as follows:

Additive fibrils: the thin microtome sections of the filaments were studied by transmission electron microscopy followed by evaluation by image analysis, with the diameter of the fibrils being determined, and the length being estimated from the particle diameter determined in samples immediately after the spinneret.

The intrinsic viscosity (I.V.) was determined on a solution of 0.5 g of polyester in 100 ml of a mixture of phenol and 1,2-dichlorobenzene (3:2 parts by weight) at 25° C.

In order to determine the melt viscosity (initial viscosity), the polymer was dried under reduced pressure to a water content of ≦1000 ppm (polyester ≦50 ppm). The granules were subsequently introduced onto the heated measurement plate of a plate-and-cone rheometer, type UM100, Physica Meβtechnik GmbH, Stuttgart/DE, with aeration with nitrogen. The measurement cone (MK210) was positioned on the measurement plate after the sample had melted, i.e. after about 30 seconds. The measurement was started after a further heating period of 60 seconds (measurement time=0 seconds). The measurement temperature was 290° C. for polyethylene terephthalate and additive polymers which are added to polyethylene terephthalate, or was the same as the melting point of the polyester in question plus 34.0° C. The defined measurement temperature corresponds to the typical processing or spinning temperature of the respective polyester. The amount of sample was selected in such a way that the rheometer gap was completely filled. The measurement was carried out in oscillation at the frequency 2.4 Hz (corresponding to a shear rate of 15 sec$^{-1}$) and a deformation amplitude of 0.3, and the value of the complex viscosity was determined as a function of the measurement time. The initial viscosity was then converted to the measurement time zero by linear regression.

For the determination of the glass transition temperature and the melting point of the polyester, the polyester sample was firstly melted at 310° C. for 1 minute and immediately quenched to room temperature. The glass transition temperature and the melting point were subsequently determined by DSC (differential scanning calorimetry) measurement at a heating rate of 10° C./min. The pre-treatment and measurement were carried out with nitrogen aeration.

The birefringence of the fibres ($\Delta\eta$) was determined by means of a polarizing microscope with tilt compensator and green filter (540 nm) using wedge sections. The path difference between the ordinary and extraordinary ray on the passage of linear-polarized light through the filaments was measured. The birefringence is the quotient of the path difference and the filament diameter. In the case of the spin-stretch process, the spun filament was removed after the take-off godet roll.

The strength properties of the fibres were determined on filaments to which a twist of 50 T/m had been applied, on a test length of 250 mm with a take-off speed of 200 mm/min. The force corresponding to an elongation of 5% in the stress-strain diagram, divided by the titre is referred to here as LASE-5.

The hot-air shrinkage was determined using the shrinkage tester from Testrite/USA, at 160° C., a pre-stress force of 0.05 cN/dtex and a treatment duration of 2 minutes.

COMPARATIVE EXAMPLES 1 AND 2

Polyethylene terephthalate chips having an intrinsic viscosity of 0.98 dl/g and a moisture content of 20 ppm were melted at a temperature of 295° C. in a 7E extruder from Barmag, DE, forced through a product line with installed static mixers at a pressure of 160 bar and fed to a 2×15 $cm^3$ spinning pump. The polymer melt was subjected to a shear rate of 29 $sec^{-1}$ in the process. The product of the shear rate and the residence time in seconds to the power 0.8 was 532. The spinning pump transported the melt held at a temperature of 298° C. into two spin packs with rectangular spinneret plate (200 holes, hole diameter 0.4 mm). The melt throughput per spin pack was 385 g/min at all settings. This corresponds to a titre of 1100 dtex at a wind-up speed of 3500 m/min. The spinneret pressure was 330 bar. After the spinneret, the spun multifilament passed through a post-heater (330° C.) having a length of 330 mm, was then cooled in a cross-blowing system, treated with spin finish by means of slot oiler and fed to an unheated pair of feed rolls. The speed of this pair of feed rolls is referred to by agreement as the spinning take-off speed. Only for sampling for determination of the birefringence was the spun filament fed to a wind-up unit after this pair of feed rolls. In order to produce the high-strength filament, the filament was fed over 4 heated pairs of godet rolls after the pair of feed rolls and finally wound up. The stretching was carried out between the 1st and 3rd pairs of godet rolls, the heat setting on the 3rd pair of godet rolls, and the relaxation between the 3rd pair of godet rolls and the spooler (where the relaxation ratio is the ratio of the wind-up speed to the speed of the pair of heat-setting godet rolls).

The 4 heated pairs of godet rolls had the following temperatures:

Pair 1: 95° C.

Pair 2: 120° C.

Pair 3: 240° C.

Pair 4: 150° C.

The pre-stressing ratio between pair 1 and the pair of feed rolls was 1.02 in all cases. The partial relaxation ratio between pair 4 and pair 3 was 0.995 in all cases.

The other experimental parameters and the results are shown in the table.

EXAMPLES 3 TO 7

The procedure and the polyethylene terephthalate (PET) correspond to the comparative examples. However, in order to prepare the polymeric mixture in accordance with the invention, an additive was metered into the feed part of the extruder by means of a KCLKQX2 metering device from K-Tron Soda, DE. The additive selected was a copolymer comprising 90% by weight of methyl methacrylate and 10% by weight of styrene which had a glass transition temperature of 118.7° C. and a melt viscosity ratio, based on PET, of 2.8. The metered amount indicated in the table was set in accordance with a gravimetric metered-amount control system.

The other experimental parameters and the results are shown in the table. In all cases, the mean diameter of the fibrils in the filaments was less than 80 nm.

TABLE

| | | Example No. | | | | | |
|---|---|---|---|---|---|---|---|
| | | 1 Comp. | 2 Comp. | 3 Inv. | 4 Inv. | 5 Inv. | 6 Inv. |
| Spinning take-off speed | m/min | 550 | 750 | 700 | 800 | 920 | 980 |
| Additive concentration | wt. % | 0 | 0 | 0.6 | 0.95 | 1.5 | 1.8 |
| Birefringence | $\times 10^{-3}$ | 1.9 | 3.9 | 1.8 | 1.9 | 2.2 | 2.8 |
| 1st stretching | 1: | 4 | 3.5 | 4 | 4 | 4 | 4 |
| Overall stretching | 1: | 5.8 | 5.35 | 5.82 | 5.78 | 5.7 | 5.5 |
| Overall relaxation ratio | 1: | 0.976 | 0.975 | 0.978 | 0.979 | 0.98 | 0.98 |
| Wind-up speed | m/min | 3170 | 3980 | 4060 | 4600 | 5240 | 5380 |
| Yarn viscosity (I.V.) | dl/g | 0.88 | 0.88 | 0.88 | 0.88 | 0.88 | 0.88 |
| Tear strength | cN/tex | 85.7 | 78.2 | 84.3 | 82.9 | 81.3 | 80.4 |
| Elongation at break | % | 13.2 | 13.6 | 13.5 | 13.9 | 13.2 | 14 |
| LASE 5 | cN/tex | 39.1 | 38.6 | 38.5 | 38.1 | 39.1 | 36.3 |
| Shrinkage (160° C.) | % | 5.9 | 5.8 | 5.8 | 5.6 | 5.6 | 5.5 |

What is claimed is:

1. High strength polyester filaments having a tear strength of >70 cN/tex consisting of α) a polyester comprising at least 85 mol % of poly($C_{2-4}$-alkylene) terephthalate.

β) from 0.1 to 2.0% by weight of an incompatible, thermoplastic, amorphous, polymeric additive having a glass transition temperature in the range from 90 to 170° C., and γ) from 0 to 5.0% by weight of further additives, where the sum of α), β) and γ) is equal to 100%, the ratio of the melt viscosity of the polymeric additive β) to the melt viscosity of the polyester component α) is from 1:1 to 7:1, and the polymeric additive β) is present in the yarn in the form of fibrils having a mean diameter of ≦80 nm which are distributed in the polyester component α).

2. High-strength polyester filaments according to claim 1, wherein the ratio of the melt viscosities is from 1.5:1 to 5:1.

3. High-strength polyester filaments according to claim 1 wherein the polymeric additive β) is a copolymer which comprises the following monomer units:

A=acrylic acid, methacrylic acid or $CH_2{=}CR{-}COOR^1$, where R is an H atom or a $CH_3$ group, and $R^1$ is a $C_{1-15}$-alkyl radical or a $C_{5-12}$-cycloalkyl radical or a $C_{6-14}$-alkyl radical, B=styrene or $C_{1-3}$-alkyl-substituted styrenes, where the copolymer consists of from 60 to 98% by weight of A and from 2 to 40% by weight of B.

4. High-strength polyester filaments according to claim 3, wherein the copolymer consists of from 83 to 98% by weight of A and from 2 to 17% by weight of B.

5. High-strength polyester filaments according to claim 3 wherein the copolymer consists of from 90 to 98% by weight of A and from 2 to 10% by weight of B.

6. High-strength polyester filaments according to claim 1 wherein the polymeric additive β) is a copolymer which comprises the following monomer units:

C=styrene or $C_{1-3}$-alkyl-substituted styrenes,

D=one of more monomers of the formula I, II or III (I)

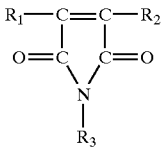

(II)

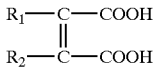

(III)

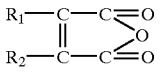

where $R_1$, $R_2$ and $R_3$ are each an H atom or a $C_{1-15}$-alkyl radical or a $C_{5-12}$-cycloalkyl radical or a $C_{6-14}$-aryl radical, and where the copolymer consists of from 15 to 95% by weight of C and from 5 to 85% by weight of D, where the sum of C and D together gives 100%.

7. High-strength polyester filaments according to claim 6, wherein the copolymer consists of from 50 to 90% by weight of C and from 10 to 50% by weight of D, where the sum of C and D together gives 100%.

8. High-strength polyester filaments according to claim 7, wherein the copolymer consists of from 70 to 85% by weight of C and from 15 to 30% by weight of D, where the sum of C and D together gives 100%.

9. High-strength polyester filaments according to claim 1 wherein the copolymer additive β) is a copolymer which comprises the following monomer units:

E=acrylic acid, methacrylic acid or $CH_2{=}CR{-}COOR^1$, where R is an H atom or a $CH_3$ group, and $R^1$ is a $C_{1-15}$-alkyl radical or a $C_{5-12}$-cycloalkyl radical or a $C_{6-14}$-aryl radical.

F=styrene or $C_{1-3}$-alkly-substituted styrenes,

G=one of more monomers of the formula I, II or III (I)

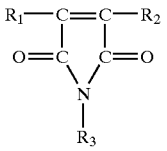

(II)

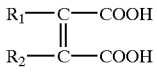

-continued (III)

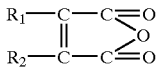

where $R_1$, $R_2$ and $R_3$ are each an H atom or a $C_{1-15}$-alkyl radical or a $C_{5-12}$-cycloalkyl radical or a $C_{6-14}$-aryl radical, H=one or more ethylenically unsaturated monomers which can be copolymerized with E and/or with F and/or G, from the group consisting of α-methylstyrene, vinyl acetate, acrylates and methacrylates which are different from E, vinyl chloride, vinylidene chloride, halogen-substituted styrenes, vinyl esters, isopropenyl ethers and dienes, where the copolymer consists of from 30 to 99% by weight of E, from 0 to 50% by weight of F, from >0 to 50% by weight of G and from 0 to 50% by weight of H, where the sum of E, F, G and H together gives 100%.

10. High-strength polyester filaments according to claim 9, wherein the copolymer consists of from 45 to 97% by weight of E, from 0 to 30% by weight of F, from 3 to 40% by weight of G and from 0 to 30% by weight of H, where the sum of E, F, G and H together gives 100%.

11. High-strength polyester filaments according to claim 10, wherein the copolymer consists of from 60 to 94% by weight of E, from 0 to 20% by weight of F, from 6 to 30% by weight of G and from 0 to 20% by weight of H, where the sum of E, F, G and H together gives 100%.

12. Process for the production of the high-strength polyester filaments of claim 1, wherein a) a polyester α) which comprises at least 85% mol % of poly-($C_{2-4}$-alklylene)therephthalate and from 0.1 to 2.0% by weight of an incompatible, thermoplastic, amorphous, polymeric additive β) which has a glass transition temperature in the range from 90 to 170° C., where the ratio of the melt viscosity of the polymeric additive β) to the melt viscosity of the polyester component α) is from 1:1 to 7:1, where these may comprise from 0 to 5.0% by weight of further additives γ), are mixed in the molten state in a static mixer with shearing, where the shear rate is from 16 to 128 $sec^{-1}$, and the product of the shear rate and the residence time in the mixer in seconds to the power 0.8 is set to a value of at least 250;

b) the melt mixture from step a) is spun to give spun filaments, where the spinning take-off speed is from >700 to 1500 n/min; and c) the spun filaments from step b) are stretched, heat-set and wound up, where the stretching ratio is at least 1:5.

13. Process for the production of high-strength polyester filaments according to claim 12, wherein the spinning take-off speed is from 750 to 100 m/min.

14. Process for the production of high-strength polyester filaments according to claim 13, wherein the concentration C of the polymeric additive is selected in the range of 0.1 to 2.0% by weight in such a way that the birefringence of the spun filaments is $<3.5\cdot10^{-3}$.

* * * * *